United States Patent [19]

Slagle

[11] 3,930,598

[45] Jan. 6, 1976

[54] LIQUID DISPENSING APPARATUS

[75] Inventor: William E. Slagle, Canfield, Ohio

[73] Assignee: Bildon Company, North Lima, Ohio

[22] Filed: Mar. 28, 1974

[21] Appl. No.: 455,627

[52] U.S. Cl. ..... 222/129.4; 222/132; 222/145; 222/325; 137/266

[51] Int. Cl.[2] ..... B67D 5/56

[58] Field of Search ..... 222/188, 162, 185, 189, 222/145, 6, 1, 129, 129.4, 144.5, 135, 132, 325; 137/259, 266

[56] References Cited

UNITED STATES PATENTS

| | | | |
|---|---|---|---|
| 1,772,545 | 8/1930 | Hilty | 222/162 X |
| 2,109,259 | 2/1938 | Yirava | 222/325 X |
| 2,453,080 | 11/1948 | Shimp | 222/185 |
| 2,547,823 | 4/1951 | Josephian | 222/6 X |
| 2,618,410 | 11/1952 | Merow | 222/162 X |
| 2,711,268 | 6/1955 | Cannella | 222/145 X |
| 2,962,193 | 11/1960 | Totten | 222/145 |
| 3,217,887 | 11/1965 | Meister | 222/189 X |
| 3,647,118 | 3/1972 | Johnson et al. | 222/132 X |

*Primary Examiner*—Allen N. Knowles
*Assistant Examiner*—Hadd Lane
*Attorney, Agent, or Firm*—Fay & Sharpe

[57] ABSTRACT

A liquid dispensing apparatus for sequentially gravity feeding the liquid contents from a plurality of liquid containers into a closed manifold for selective dispensing therefrom. The manifold itself is disposed in a generally horizontal position and includes a plurality of individual container receivers extending generally vertically upward therefrom and in liquid communication therewith. Each receiver includes means for supporting a liquid container in an inverted, vertically disposed position with successive ones of the containers having their liquid outlets positioned at a different vertical level than the liquid outlet levels of the other containers. This arrangement permits the establishment of an initial steady state liquid level wherein all the container liquid outlets are at least covered by liquid to prevent further liquid flow therefrom. When a selected portion of liquid is removed from the manifold for dispensing or other use, the initial steady state liquid level is temporarily lowered so as to uncover the highest vertically disposed container liquid outlet. This uncovering permits air to flow into the container to facilitate liquid flow therefrom until the initial steady state liquid level is again reestablished to block further liquid flow. At all times during liquid dispensing from the manifold itself, replacement liquid is only drawn from the container having its liquid opening at the highest vertical level and which also has liquid therein. The arrangement further includes a normally closed flow valve associated with each container. A container support and sealing means is provided for each receiver to assure proper location and retention of the containers relative thereto.

25 Claims, 8 Drawing Figures

20
40
42
44
45
46
48
50
52
54
56
58
64
66
68
70
80
82
84
90
98
104
106
108
110
112
128
160
200
202
300
302
X
3.
4.
a
b
m
n
o
p

FIG. 5.
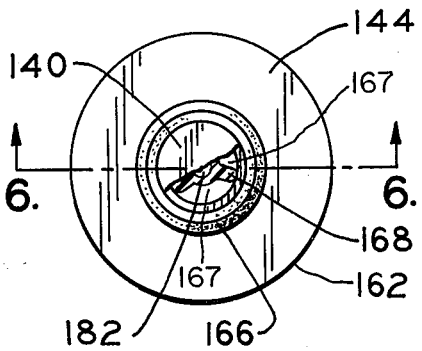
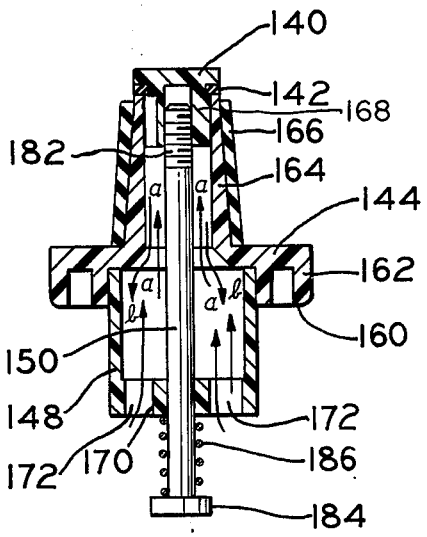
FIG. 6.
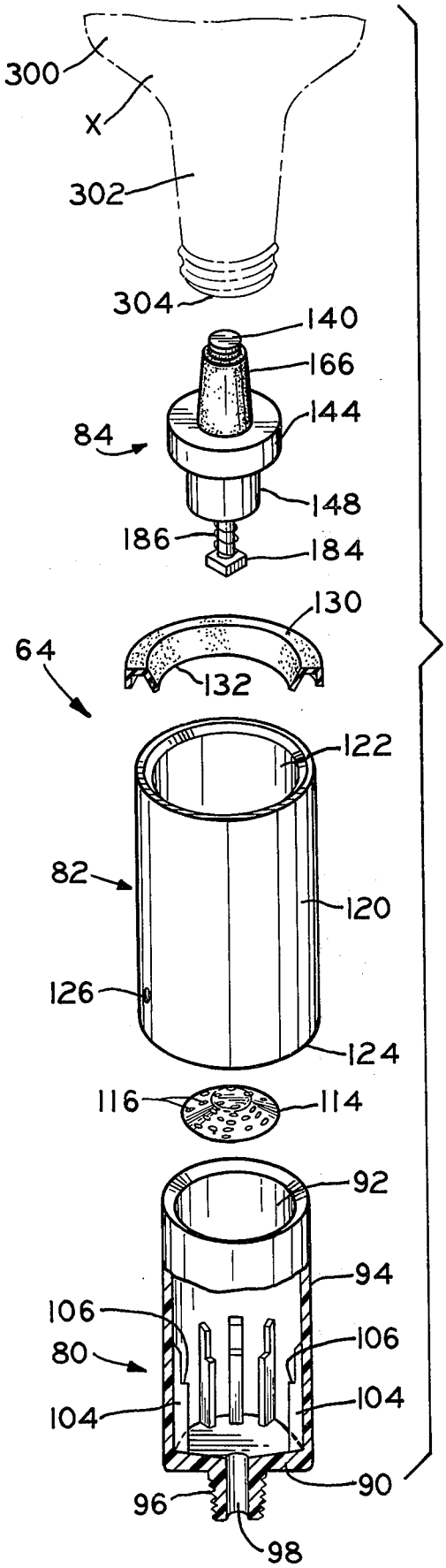
FIG. 7.

LIQUID DISPENSING APPARATUS

BACKGROUND OF THE INVENTION

This invention pertains to the art of liquid dispensing and more particularly to sequential liquid dispensing from a plurality of liquid containers.

The invention is particularly applicable to sequentially dispensing liquor from a plurality of conventional liquor bottles and will be described with particular reference thereto; however, it will be appreciated by those skilled in the art that the invention has broader applications and may be conveniently employed in other environments where it may be desired to maintain a continuously available reserve of a particular liquid for sequential dispensing from individual liquid containers.

Conventionally, in lounges or bars in which liquor is normally sold in large volume, a bartender has been charged with the responsibility of precisely pouring a specified amount of liquor of a particular brand or type into a shot glass and then, in turn, into a drink glass for necessary mixing and serving to a customer. In servings of this type, it is fully intended that the customer only receive a specified amount of the liquor in the drink for the price charged for the drink itself. By way of example, an ounce to an ounce and one quarter per shot have been conventionally employed. With this particular measurement and assuming no spillage, overpouring and so on, a specific number of total shots are expected to be obtained from each bottle of liquor in order that the proprietor of the bar or lounge may realize a profit on his sales.

As in any human endeavor, however, and since the bartender merely "sights" for the proper amount of liquor poured into the shot glass, the possibility for mistake and/or deception exists if the bartender is not extremely careful in his pourings. It has been found that because bartenders are normally in a great hurry to mix drinks for customers or that they just do not take care in their liquor pourings, substantial unexplained liquor losses in this type of operation have been quite common. In addition, it has been known in the trade that certain bartenders do not concern themselves with any type of liquor control such that entire bottles of liquor may be unaccounted for following removal from the storeroom area. Obviously, in this type of operation many people may have ready access to the storeroom without the knowledge of the proprietor or even the bartender. Liquor losses attributed to these problems, again, cut heavily into the proprietor's profits on the overall bar or lounge operation.

With the above described problems being known, various means have thus far been developed in an effort to eliminate or at least reduce their criticality. Certain of these developments have taken form as liquor dispensing machines which automatically dispense a precise amount of liquor from a liquor bottle in order to maintain liquor control as to the individual servings made therefrom. However, it was found that when such systems were connected to only one bottle of liquor, valuable personnel time was lost in having to disconnect a single empty bottle from the apparatus and replace it with a new, full bottle. Therefore, various means have been developed to facilitate interconnection of a plurality of bottles of the same liquor so that the frequency of necessary bottle changes could be substantially reduced. With these various improved arrangements, it was found that the actual liquor supply for the dispensing apparatus could be located in, for example, a special room isolated from the bar or serving area itself. Also, the liquor supply may be conveniently located adjacent the bar as in, for example, a locked cabinet. In this instance, the liquor is pumped through tubes from the liquor supply location to the serving area. Inasmuch as a number of bottles of the same type of liquor were associated with the dispensing units, the necessity for replacing exhausted bottles could be eliminated for an entire evening or shift by merely forecasting the amount of a specific type of liquor which would normally be sold during any single evening or shift. Arrangements for the actual dispensing of liquor at the bar area which has been received from the liquor supply are known in the art and generally comprise either stationary console arrangement with a plurality of individual dispensing tubes disposed therealong or hand held dispensing heads having a plurality of dispensing tubes leading thereto.

Further developments to automatic liquor dispensing systems have included automatic counters for determining the precise amount of each type of liquor dispensed through the system as well as interconnection with cash registers in order that a tab or constant record may be maintained for the bar or lounge operation. Although the overall concept of automated liquor dispensing systems has found substantial acceptance in the industry, some basic problems have thus far remained as to the means for and method of interconnecting a plurality of bottles of the same type of liquor for eventual dispensing to customers.

More specifically, many arrangements employed means for connecting the bottles in a series relationship with each other. These means comprised liquid flow tubes passing from bottle to bottle so that liquor could sequentially flow from bottle to bottle and then to the actual dispensing apparatus. In this type of system, either vacuum pressure or positive pressure was used to cause liquor flow through and out of the bottles. Such arrangements have had several drawbacks, however, including the possibility of bottle explosions caused by application of pressure to the bottles in the system. Not only does such a situation establish potential for serious bodily harm, but it also presents a situation where, in the event of bottle explosion, a substantial liquor loss from a break in the system could be encountered.

Besides the operational difficulties of such systems, the United States Department of the Treasury maintains regulations that require that bar dispensing equipment for use by retail liquor dealers (1) must avoid an in-series hookup which would permit the contents of liquor bottles to flow from bottle to bottle before reaching the dispensing spigot or nozzle, (2) must not dispense from or utilize containers other than the original liquor bottles filled, stamped and labeled in conformity with Government regulations, (3) must not permit intermixing of different kinds of products or brands and (4) must not damage or obscure the portion of the strip (tax) stamp required to remain on a liquor bottle after opening. Thus, the systems described above are not in conformity with all of these Government requirements.

Other attempts at designing structures for drawing liquor from a plurality of bottles for serving to customers have been made. For example, systems have been developed wherein the uppermost neck portions of the bottles are substantially submerged in a liquor well and the liquor then drawn from the well for dispensing to customers. These structures, in addition to proving somewhat clumsy and undesirable due to the amount of liquor actually stored in the well, also run afoul of Government regulations. Specifically, in substantially submerging the neck portions of the liquor bottles, the strip (tax) stamps affixed thereto are permitted to be soaked off the bottles.

Although a number of other alternative arrangements to overcome the above discussed problems have thus far been attempted, none have proved to be particularly desirable from the standpoint of a bar or lounge proprietor. These other alternatives still require either application of some type of pressure to the bottles and further involve the use of costly valving, pumping and housing structures which add undesirable cost and do not alleviate potential safety hazards.

The present invention, however, contemplates a new and improved method and apparatus which overcomes all of the above referred to problems and others and provides new liquor dispensing method and apparatus which are simple, economical, do not require the application of positive or negative pressures to the liquor bottles themselves, permit each bottle to be emptied sequentially and individually from the other bottles of the same liquor, meet all present Government regulations for liquor dispensing systems and which are readily adaptable for use in liquid supply systems in other environments.

BRIEF DESCRIPTION OF THE PRESENT INVENTION

In accordance with the present invention, there is provided a new method and apparatus for sequentially supplying liquid from a plurality of individual liquid containers by means of gravity feed. The apparatus includes a manifold member having a plurality of container receivers disposed such that a portion of the associated containers may be received therein in a manner whereby all the container liquid contents may selectively pass into the manifold by gravity for dispensing or other use. The receivers each include means for supporting an associated container in a position relative to the other containers so that at least certain ones of the containers have their liquid outlets positioned at different vertical heights from the others. Liquid from the containers fills the manifold and a portion of the receivers to establish an initial steady state liquid level wherein all the container fluid outlets are at least covered by liquid to prevent liquid flow therefrom. When a portion of the liquid in the manifold is removed for dispensing or other use, the initial steady state liquid level is temporarily lowered to uncover the uppermost outlet to facilitate liquid flow therefrom until the initial steady state liquid level is reestablished. Liquid withdrawal from that particular container will periodically continue in this manner until it is emptied and a new steady state liquid level is established as to the next uppermost vertically disposed container liquid level. The dispensing operation may then similarly continue until all of the plurality of containers have been separately emptied or until those containers first emptied have been replaced with new, full ones.

In accordance with another aspect of the present invention, a liquid flow valve is provided to selectively block liquid flow from each container when it is not positioned relative to a container receiver on the manifold itself. The valves each further include means for positively engaging the associated receiver for permitting liquid flow therefrom and for precisely locating the container in the receiver.

In accordance with another aspect of the present invention, a container receiving and supporting means is provided for use in a multiple liquid container dispensing manifold which comprise in combination a receptor and a liquid control valve. The receptor has a bottom wall, an open top end and a continuous side wall defining a cup-like structure adapted to receive a portion of a liquid container, including the liquid outlet, and the bottom wall includes a liquid flow port adapted to communicate with the manifold. The liquid flow control valve includes a body plug or cork-like portion adapted to be closely received in the container liquid outlet and a selectively movable seal portion for normally preventing liquid flow from the container. The receptor further includes support means for precisely locating a container with the liquid outlet disposed such that substantially all of the liquid contents may be emptied therefrom by gravity. The flow control valve also includes means for engaging the receptor support means and means for moving the valve to an opened condition as the container is placed in the receptor.

In accordance with a more limited aspect of the present invention, the receptor includes a container support which is selectively movable from a first non-supporting position to a second supporting position closely spaced to an associated container.

In accordance with still another aspect of the present invention, a method of dispensing liquid from a plurality of containers in a desired order of sequence is provided which comprises the steps of:

a. placing a plurality of containers in liquid flow communication with a manifold such that substantially all of the liquid contents of the containers are free to flow from the container fluid outlets into the manifold;
b. locating the plurality of containers relative to each other such that a first steady state liquid level is created by liquid issuing from at least one of the containers to at least cover all of the container fluid outlets with the liquid outlet for at least one container being covered to a lesser extent than the other of the container liquid outlets;
c. withdrawing a selected amount of the liquid from an outlet port in the manifold;
d. permitting the initial steady state liquid level to temporarily drop during the withdrawing step an amount sufficient to uncover the liquid outlet of the at least one container; and,
e. allowing liquid to flow from the at least one container to reestablish the initial steady state liquid level.

In accordance with yet another more limited aspect of the present invention, the method further includes the step of continuously repeating the steps of withdrawing, permitting and allowing until all the liquid in the at least one container has flowed therefrom and establishing a second steady state liquid level vertically below the initial level which covers the liquid openings for all the other of the plurality of containers.

The principal object of the present invention is the provision of a new method and apparatus for sequentially dispensing liquid from a plurality of liquid containers.

Another object of the present invention is the provision of a new method and apparatus for sequentially dispensing liquid from a plurality of containers which is simple in design.

Another object of the present invention is the provision of a new method and apparatus for sequentially dispensing liquid from a plurality of liquid containers which is inexpensive.

Another object of the present invention is the provision of a new method and apparatus for sequentially dispensing liquid from a plurality of liquid containers which operates by gravity as selected amounts of the liquid are removed from the overall system.

Still another object of the present invention is the provision of a new method and apparatus for sequentially dispensing liquid from a plurality of liquid containers which does not require pumping the liquid from one to another of a plurality of containers.

Yet another object of the present invention is the provision of a new method and apparatus for sequentially dispensing liquid from a plurality of liquid containers which does not require substantial immersion of the containers themselves during the dispensing operation.

Still a further object of the present invention is the provision of a new method and apparatus for sequentially dispensing liquid from a plurality of liquid containers which are readily adapted to use with a plurality of container configurations and sizes.

Yet a further object of the present invention is the provision of a new method and apparatus for sequentially dispensing liquid from a plurality of liquid containers which are readily adapted to use with a plurality of different liquids in a plurality of liquid dispensing environments.

BRIEF DESCRIPTION OF THE DRAWINGS

The invention may take physical form in certain parts and arrangement of parts, a preferred embodiment of which will be described in detail in the specifications and illustrated in the accompanying drawings which form a part hereof and wherein:

FIG. 5 is a plan view of a liquid flow valve received in a liquid container with a portion thereof broken away to show the liquid and air flow path;

FIG. 6 is a cross-sectional view of the valve taken along lines 6—6 of FIG. 5;

FIG. 7 is an exploded view of the bottle receiver structure employed in the manifold of the subject invention; and, FIG. 8 is a schematic view showing an alternative arrangement for interconnecting a plurality of separate manifolds to provide a greater supply of liquid available at any one time.

Figure 1:
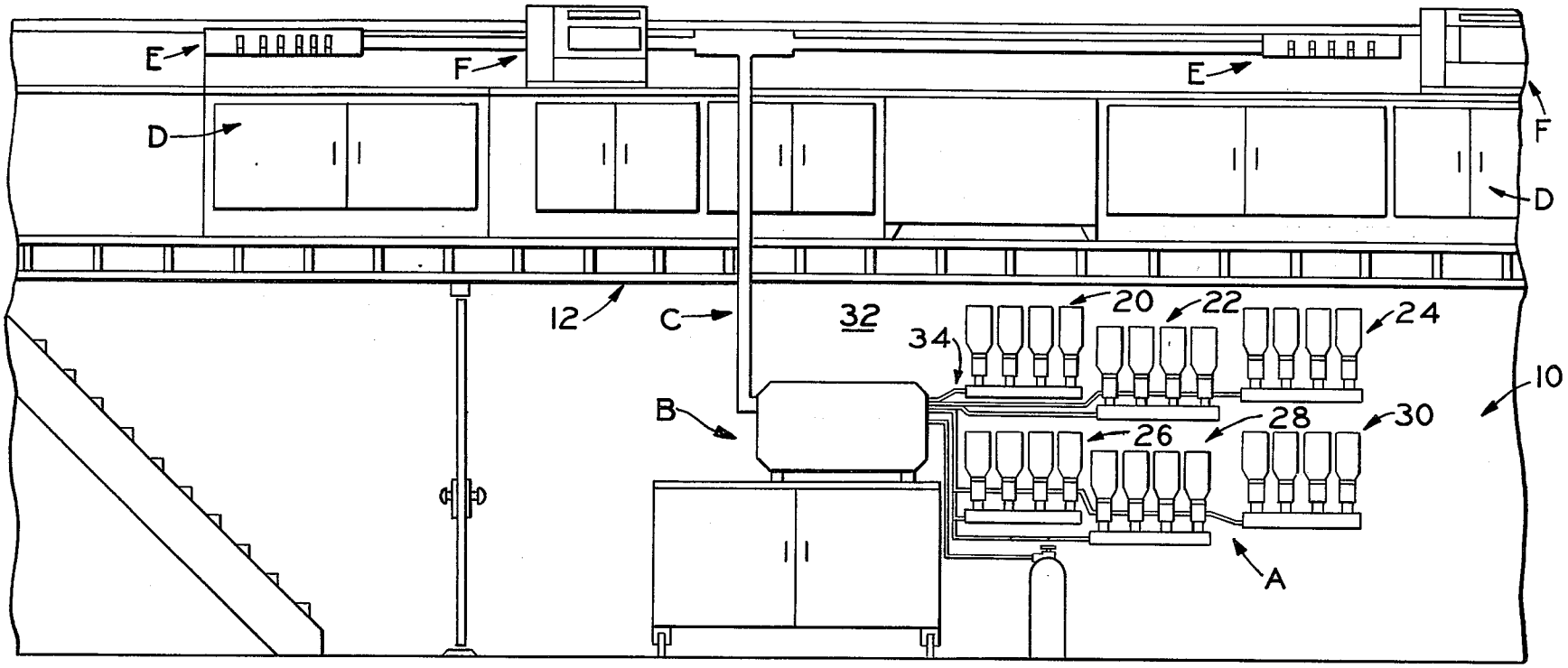
FIG. 1 is a view showing a particular environment wherein the concepts of the subject application may be employed.

Referring now to the drawings wherein the showings are for purposes of illustrating the preferred embodiment of the invention only and not for purposes of limiting same, the FIGURES show a plurality of liquor supply manifolds A for supplying different types of liquor to a dispensing area. These supply manifolds are interconnected to a liquor pump arrangement B which selectively feeds the liquor through a plurality of separate lines which collectively comprise main supply line C to a bar or serving area D. The serving lines are connected to liquor dispensing devices E which, in turn, are interconnected to cash registers or accounting mechanisms F. Basically, this type of overall supply system is known in the art and, except for the specific manifold arrangement and method there employed, the additional elements are not described in greater detail since they do not, in and of themselves, form a part of the present invention. The various system components as well as their relative locations are merely shown to illustrate a typical environment for and operation of the subject invention.

More specifically and in the typical arrangement shown in FIG. 1 which employs an automated liquor dispensing system, the supply apparatus, including the liquor itself, is placed in a liquor supply room 10 disposed beneath the main floor 12 of a bar installation. Obviously, this equipment could be conveniently located elsewhere as available space and/or construction of the bar area may so dictate. The liquor is drawn as needed from a plurality of liquor supply manifolds generally designated 20,22,24,26,28 and 30 which are conveniently mounted to wall 32 in the liquor supply room in a generally horizontal position. Liquor supply lines 34 extend from each supply manifold into the liquor pump apparatus B for eventual distribution to customers through the rest of the automated equipment. Each of the liquor supply manifolds as shown in FIG. 1 contains a different type of liquor in order that a plurality of such liquors may be conveniently automatically dispensed. That is, the liquor in supply manifold 20 is of a different type than the liquor in the other of these supply manifolds and so on for the remainder of manifolds 22,24,26,28 and 30.

Figures 2, 4:
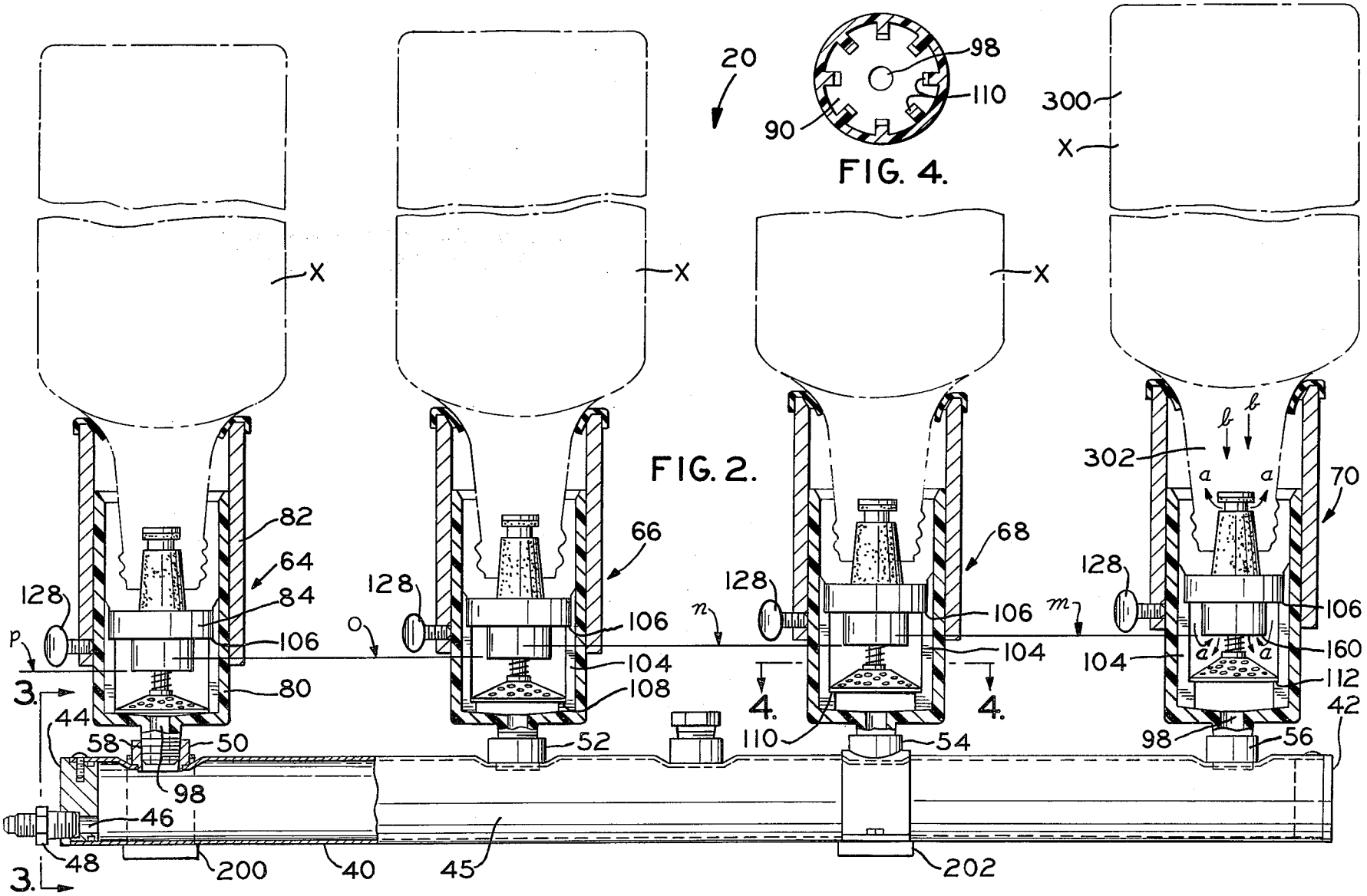
FIG. 2 is a view in partial cross-section showing the particular manifold arrangement of the subject application.
FIG. 4 is a cross-sectional view taken along lines 4—4 of FIG. 2.

For a more specific description of the manifold arrangement itself, description will be made hereafter to liquor supply manifold 20, it being understood that the construction and operation of the other of the manifolds is substantially identical thereto except where otherwise specifically noted. Referring now to FIG. 2, supply manifold 20 comprises an elongated manifold tube 40 having closed ends 42,44 to define a chamber 45 with a liquor outlet port 46 disposed in end 44. A conventional tube fitting or connector 48 is received in outlet port 46 for convenient interconnection of the manifold through the associated line 34 to the remainder of the dispensing system. Although the manifold tube could be constructed from a number of metallic or plastic materials, thin walled stainless steel tubing is preferred. Extruded plastic manifolds having an internal liquor chamber have been successfully employed.

Spaced longitudinally along the top of manifold tube 40 are a plurality of receiver fittings generally designated 50,52,54 and 56. Although any number of such fittings may be employed as desired to accommodate a plurality of liquor bottles, four fittings are shown in the preferred embodiment. However, a greater or lesser number of these fittings for accommodating a greater or lesser number of bottles may be employed subject to the specific structural considerations to be more fully described and explained hereinbelow. As will be best seen with reference to receiver fitting 50, each fitting includes a threaded receiving hole 58 extending therethrough communicating with chamber 45 of the manifold tube itself. Although a number of materials may be employed in manufacturing the fittings, the preferrred embodiment here under discussion contemplates use of stainless steel ones which are rigidly affixed to the manifold tube itself by conventional means.

As also shown in FIG. 2, the receiver fittings each have a bottle receiver associated therewith, that is, receiver fittings 50,52,54 and 56 have bottle receivers 64,66,68 and 70 respectively associated therewith. Inasmuch as the basic construction for each bottle receiver is identical with the others, structural description will hereafter be made with reference to receiver 64, it being understood that the other bottle receivers are identical thereto except as specifically noted.

With particular reference to FIGS. 5, 6 and 7, bottle receiver 64 comprises a receptor generally designated 80, an outer bottle support sleeve generally designated 82 and a liquid flow control valve generally designated 84.

Receptor 80 includes a bottom wall 90, an open top end 92 and a continuous side wall 94 so as to define a generally cylindrical cup-like configuration. A threaded protrusion 96 extends outwardly from bottom wall 90 and is adapted for tight sealing threaded engagement with the associated receiver fitting 50 on the manifold tube. A liquid outlet port 98 extends through bottom wall 90 and protrusion 96 in order that there may be fluid communication between the receptor and chamber 45. Extending longitudinally along a portion of the inside of side wall 94 from bottom wall 90 toward open top end 92 are a plurality of longitudinal ribs 104. Although any number of these ribs may be employed, eight ribs equally spaced about side wall 94 are contemplated in the preferred embodiment. Each rib includes an inwardly extending relief area or notch 106 in order to define a step like area and cumulatively establish a shelf or container support means.

FIG. 2 best shows the specific structural arrangements for bottle receivers 66,68 and 70 which each vary slightly from the specific arrangement for bottle receiver 64 and from each other. It should be noted in the FIGURE that ribs 104 of the bottle receiver 66 receptor include a second relief area or notch 108 adjacent the receptor bottom wall, that ribs 104 of the bottle receiver 68 receptor include a second relief area or notch 110 adjacent the receptor bottom wall and that ribs 104 of the bottle receiver 70 receptor include a second relief area or notch 112 adjacent the receptor bottom wall. These second relief areas or notches 108, 110 and 112 are progressively spaced a greater distance from the bottom wall of their associated receptors for reasons which become readily apparent hereinafter in the subsequent discussion of the manifold operation. It should be particularly noted that the distances between bottom wall 90 and notches 106 in bottle receiver 64, notches 108 and 106 in bottle receiver 66, notches 110 and 106 in bottle receiver 68 and notches 112 and 106 in bottle receiver 70 are all substantially equal to each other. Notches 108, 110 and 112 are merely to compensate for a slight difference in elevation between the associated liquor bottles for reasons which will be fully explained.

As seen best in FIGS. 2 and 7, a generally frusto-conical liquid strainer or screen 114 is received in each receptor. These screens include a plurality of small openings 116 therein to permit liquor flow therethrough. In the preferred arrangement, the screens are stamped from metal to provide structural strength although other or conventional screens could be employed. In the receiver 64 receptor, the screen is received on bottom wall 90, in the receiver 66 receptor, the screen is received on notches 108; in the receiver 68 receptor, the screen is received on notches 110; and, in the receiver 70 receptor, the screen is received on notches 112.

Referring again particularly to FIGS. 5, 6 and 7, outer bottle support sleeve 82 comprises a generally cylindrical sleeve 120 having an open upper end 122 and an open bottom end 124. Sleeve 120 is dimensioned so as to be closely slidably received over the outer surface of receptor side wall 94. To retain sleeve 120 in a particular adjustable position relative to the receptor for purposes which will be described, the sleeve includes a threaded receiving hole 126 extending therethrough for conveniently receiving a thumb screw 128 (FIG. 2) which may be loosened or tightened to exert a positive retaining force against the receptor. Disposed around the sleeve open upper end 122 is a deformable, generally annular gasket or bottle boot 130 which is made from rubber or similar elastomeric material. This boot includes an inner bottle engaging lip 132 to engage the side wall of the liquor bottle itself as best shown in FIG. 2. The boot may be conveniently retained in position on open end 122 by conventional means as, for example, by gluing or by merely making the boot closely interfit the open upper end.

Liquid flow control valve 84 is adapted to be closely received in the liquid outlet of a conventional liquor bottle in order to regulate liquor flow therefrom and to then be further received in a particular position in receptor 80. The valve includes a seat 140 having a gasket 142 of rubber-like material extending therearound a cap portion 144, a stem guide body 148 and an elongated operating or valve stem 150. Cap 144 has a lower surface 160 and an outer peripheral surface 162 dimensioned such that valves may be supported on notches 106 in ribs 104. The remaining portions of the ribs extending outwardly toward open end 92 from the notches themselves are for positioning the valve in a specific location within receptor 80 as best shown in FIG. 2. Extending upwardly from cap portion 144 is an integrally formed frusto-conical hollow protrusion 164 which defines a body cork and which further closely receives a frusto-conical gasket 166 thereover which is formed from rubber or similar plastic to have excellent liquid sealing characteristics when inserted into the liquid outlet of a conventional liquid bottle. Seat 140 includes an outwardly extending protrusion 168 adapted to be closely slidably received in the hollow portion of the frusto-conical body cork and which conveniently includes recessed areas 167 as shown in FIG. 5 to facilitate liquid flow therepast when the valve is in an opened position. A plurality of control valve sizes may be conveniently provided for use as to different bottle sizes in order that the manifold may be readily adapted for use with different containers and is not limited to use with one container or bottle size.

Stem guide body 148 is closely received in a receiving recess in cap 144 and generally comprises an open ended cylindrical configuration. Disposed at the lowermost end of this configuration, however, is a stem guide structure 170 which includes a passage therethrough for closely slidably receiving elongated valve stem 150. The stem guide is supported in position by means of legs 172 extending between guide 170 and guide body 148. The operating or valve stem comprises an elongated shaft like structure having a threaded end 182 adapted for threaded engagement with protrusion 168 of seat 140. The stem is closely slidably received in the passage in stem guide 170 and includes a stem head 184 at the other end thereof with an expansion type coil spring 186 being interposed between the bottom of stem guide 170 and the stem head so as to exert a continuous biasing force against the stem head. This force acts to draw seat 140 and gasket 142 into a first or normal liquid blocking position with the end of the body cork 164 as can be best seen in FIG. 6. When in this first blocking position, the distance between lower surface 160 and stem head 184 of valve 84 is greater than the distance between the top of screen 114 and notches 106 in the receptor in order that the valve may be automatically opened as will be described hereinafter. This distance differential is, however, carried forward to all the receptors and valves.

Although receptor 80, outer bottle support sleeve 82 and liquid flow control valve 84 could be manufactured from a number of materials, the preferred embodiment of the present invention contemplates use of molded polymeric materials such as, for example, high density polyethylene, polyvinylchloride or polypropylene. Other materials could, of course, be employed without departing from the intent or scope of the present invention.

Figure 3:
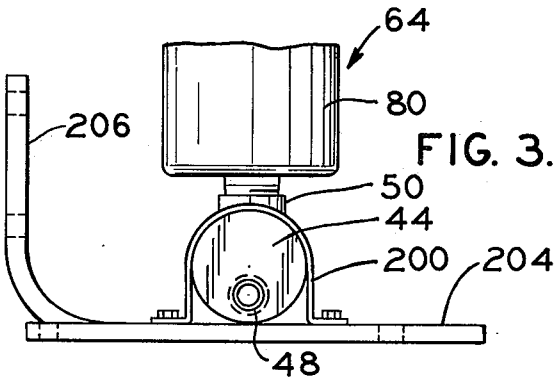
FIG. 3 is a view of the manifold arrangement of FIG. 2 taken along lines 3—3 therein.

With an appreciation of the above described structure, description will now be made to operation of liquid supply manifold 20 as shown in FIGS. 1, 2 and 3. At the outset, it should be noted that manifold tube 40 is disposed in a generally horizontal position and retained in that position by means of convenient brackets generally designated 200,202 in FIG. 3. These brackets may be mounted to a manifold plate 204 which, in turn, may be conveniently mounted by a wall bracket 206 to wall 32. The particular mounting arrangement is not deemed critical and other mounting bracket arrangements may be both conveniently and easily employed without departing from the intent and scope of the present invention.

Referring again to FIG. 2, receptors 80 for bottle receivers 64,66,68 and 70 are each threadedly mounted to the manifold tube so as to extend in a generally vertically disposed direction and outer bottle support sleeves 82 for each bottle receiver is disposed in its lowermost position relative to the associated receptor. A liquid flow control valve 84 is tightly placed in the liquid outlet opening of each of four identical bottles of liquor generally designated X in the drawings. The conventional liquor bottle, of course, has an enlarged, elongated body portion 300 which merges into a smaller, elongated neck portion 302. At the outermost end of the neck is the liquid outlet opening 304. Sealing means 166 of liquid flow control valves 84 are adapted to be closely received in openings 304 to retain the valves positioned in the bottles. Inasmuch as seat 140 and gasket 142 are continuously biased toward a liquid blocking position by operation of spring 186 against stem head 184, no liquor may flow from bottles which include valves 84 when they are placed in an inverted position.

When the liquid control valves have been inserted into each of the four bottles X, one of the bottles is inverted and placed into bottle receiver 70 such that stem head 184 engages liquid screen 116 on lower surface 160 and outer peripheral surface 162 of cap 144 rests on notches 106 in ribs 104, respectively. The distance between notches 112 and notches 106 in the bottle receiver 70 receptor are such that the weight of bottle X overcomes the outward force of spring 186 so that the valve stem is mechanically driven into the valve to move seat 140 and gasket 142 from the liquid blocking or sealing position with the body cork. Thus, air may be admitted to the inside of the bottle through the hollow inner portion of the valve and past the seat and gasket arrangement. This, in turn, permits liquor in the bottle to flow therefrom in the opposite direction. The path of the air flow in FIG. 6 and in FIG. 2 with regard to bottle receiver 70 by arrows *a* and the corresponding liquor flow path is shown in the opposite direction by arrows *b*. The structure of FIG. 6 would, of course, not permit liquor flow since the valve is closed and arrows *a* and *b* merely show the flow paths which would occur if the valve was open.

Liquor flowing from the bottle placed on bottle receiver 70 continues and passes through liquid outlet port 98 of the receptor and into manifold chamber 45. Because of the liquid head in the bottle, liquor will continue to flow from the bottle until the manifold chamber has been filled and it flows upwardly through outlet ports 98 in the receptors for bottle receivers 64,66 and 68. Obviously, if allowed, the bottle would empty itself into the manifold chamber and the bottle receiver 64,66 and 68 receptors as long as they would accept additional liquid. However, in accordance with the concepts of the subject invention, the manifold and receptors for bottle receivers 64,66,68 and 70 are only filled to that point at which the liquor covers the lowermost end of liquid control valve 84, i.e., the lower surface of guide body 148, to thus block the flow of air therethrough and into the bottle itself. At that point, further liquid flow from the bottle is prohibited and remains prohibited until the liquid level in the receptor is lowered to again uncover the bottom end of the valve and permit air flow into the bottle with resultant liquor flow therefrom.

The surface of the liquid in each receptor 80 is subjected to atmospheric pressure which enters between the facing surfaces of each receptor 80 and each sleeve 82, then passes outer periphery 162 of each cap 144 between ribs 104 outwardly of notches 106. Depending upon the shape of the bottles, atmospheric air may sometimes enter receptors 80 between the bottles and boots 130.

The initial level is designated *m* in FIG. 2 and it will be appreciated that the bottle receiver 64,66 and 68 receptors will be filled with liquor to that very same level. Thus, there is established in the manifold system an initial steady state liquid level which blocks further liquor flow from the bottle into the system unless that level is first temporarily lowered.

Once the initial steady state level, level *m*, has been reached, outer bottle support sleeve 82 for bottle receiver 70 may be slidably moved on the receptor to the position shown in FIG. 2 and thumb nut 128 tightened to retain it in that position. In the position of FIG. 2, the outer bottle support sleeve adds additional support for the bottle in properly retaining it in position to prevent undesired liquor spillage should the bottle be inadvertently bumped or jarred. Deformable gasket or bottle boot 130 engages the bottle adjacent the area of merger between the bottle body 300 and neck 302 to provide a cushioning effect for the bottle. In addition, the boot assures that no foreign material may pass from outside the dispensing system down into the receptor to contaminate the liquor itself.

Next, bottles X to be associated with bottle receivers 64,66 and 68 may be positioned in their respective bottle receivers as best shown in FIG. 2. The lowermost portions of the stem guide bodies 148 of the liquid flow control valves associated with bottle receiver 64,66 and 68 are all disposed beneath the initial steady state level *m* established by liquor in the bottle X associated with bottle receiver 70. Thus, as the bottles are inserted into the receivers and the associated liquid control valves moved from a normally closed to an opened condition, as previously described, no liquor will be permitted to flow from any of these three additional bottles. Because of the differential in vertical heights of notches 106 and bottom wall 90, notches 108, 110 and 112 of bottle receivers 64,66,68 and 70, respectively, the lower surfaces of guide bodies 148 of the valves in bottle receivers 64,66 and 68 are below the already established steady state liquid level *m* so that no air is permitted to flow upwardly through the valve to permit a corresponding discharge of liquor. It should be further noted that the lowermost portions of these valves are disposed such that additional decreasing steady state levels *n*, *o* and *p* may be eventually established as to bottle receivers 68,66 and 64, respectively, as will hereinafter be more fully described. Positioning of the outer bottle support sleeves for these three additional bottle receivers is then substantially identical as explained above with reference to bottle receiver 70.

With tube fitting or connector 48 connected to line 34 and manifold 20 and the liquor bottles in place as shown in FIG. 1, description will be made to the operation of the manifold during liquor dispensing to customers. When a particular type of liquor is to be dispensed at bar or serving area D, the appropriate button in a conventional liquor dispensing type device is merely pushed at the bar which then causes a predetermined amount of the liquor to be delivered in order that the drink may be mixed. These dispensing devices are deemed known in the art and may take any of several forms such as, for example, console or hand operated devices. Inasmuch as these devices do not form a part of the present invention, further elaboration thereon is not deemed necessary for an appreciation and understanding of the present invention.

The liquor which is drawn from the manifolds is pumped by liquor pumps B through main supply line C to the liquor dispensing devices themselves. Normally, as a shot of liquor is drawn from the dispensing device at the bar, the pump associated with that particular liquor is automatically energized to draw an amount of liquor from the manifold to replenish the supply lines to keep it filled. Thus, and assuming a shot of liquor of the type used in liquor supply manifold 20 was dispensed at the bar, the replacement liquor would be drawn outwardly from manifold 20 through outlet port 46, tube fitting 48 and into the associated liquor supply line 34. As liquor is drawn from the manifold, the overall or initial steady state level *m* is temporarily lowered from that shown in FIG. 2 to a position slightly beneath the lower surface of guide body 148 of the control valve in bottle receiver 70 to again permit air flow into liquor bottle X associated therewith which, in turn, allows liquor to issue from that bottle into manifold chamber 45 until the steady state level *m* is reestablished to stop further liquor flow. The differential in vertical heights of notches 106 in bottle receiver 64,66,68 and 70 are such that when a shot of liquor is dispensed from the liquor dispensing devices E at the bar or serving area D, level *m* is not lowered a sufficient extent to reach the next level *n* so as to allow liquor flow from the bottle associated with bottle receiver 68. Thus, during liquor dispensing operations, liquor is only drawn from that bottle which is associated with bottle receiver 70 until that particular bottle has had its liquor contents entirely emptied into the manifold.

Once the contents of the bottle receiver 70 bottle have been emptied, a new steady state liquid level is established with regard to the bottle receiver which supports its associated bottle X and the lower surface of guide body 148 of its control valve at the next lower level. In the arrangement shown in FIG. 2, the bottle would be one associated with bottle receiver 68 and would establish a new steady state level *n*. Further replacement liquor for manifold 20 would then be drawn from this bottle until it too was emptied. This process is again repeated in establishing another steady state liquid level *o* as to receiver 66 and then continue until finally, a steady state liquid level *p* was established with regard to the last or lowermost bottle receiver 64.

The above described manifold system thus provides capabilities for automatic liquor dispensing apparatus to continuously supply liquor from a plurality of bottles to eliminate the need for constant and continuous bottle changes. If, during operation of the overall dispensing apparatus and, for example, if the receivers 68 and 70 bottles have been emptied such that liquor is being drawn from the receiver 66 bottle, it is possible to replenish the spent bottles without disrupting operation of the manifold. In this regard, it is merely necessary to remove the spent bottles along with the associated liquid flow control valves and replace them with new, full bottles. In this instance, a new steady state liquid level will be reestablished at level *m* so that further liquor will be drawn from the bottle receiver 70 bottle and that liquor flow from the bottle receiver 66 bottle will be suspended until the other two, now full bottles, are again emptied. This result occurs since both of these bottles are on a higher vertical level and establish higher steady state liquid levels *m* or *n* than its own steady state liquid level *o*.

Figure 8:
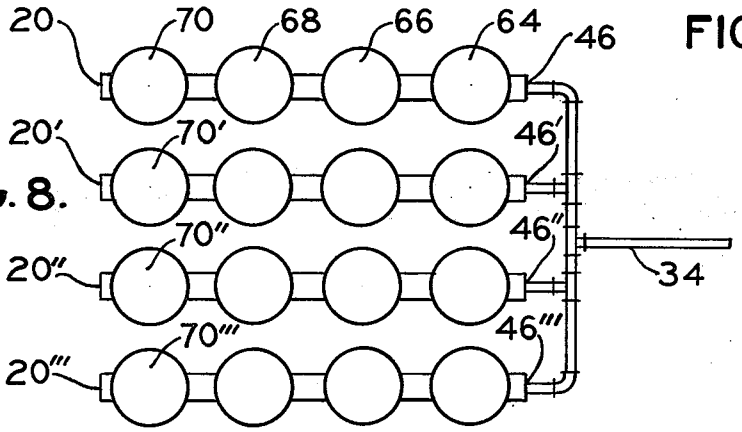

A variation of the above described structure which facilitates storage of even a greater liquor supply is schematically shown in FIG. 8. Like parts are identified by like numerals and duplication of like parts include a primed (′) suffix. This arrangement employs four of the four bottle liquor supply manifolds 20, 20′, 20″ and 20‴. The fluid outlet port 46, 46′, 46″ and 46‴ for each are interconnected to fluid supply line 34 as shown in the drawing so that liquor may be drawn from all four of the manifolds simultaneously. The operation of this system is identical with the one hereinabove described in detail with particular reference to FIG. 2 except that liquor is simultaneously drawn in substantially equal amounts from the four highest vertically disposed bottles which have liquor therein, namely, bottles 70, 70′, 70″ and 70‴. Thus, only one fourth of the amount of replacement liquor is drawn from these bottles during a single dispensing and replacement step as described with reference to the basic FIG. 2 arrangement. Other arrangements to accommodate the specific needs of a particular bar or lounge operation may, of course, use the same structural concepts and which do not depart from the scope and intent of the present invention.

In addition, it is possible to have a different number of individual bottles for each manifold assembly. That is, either more or less than the four bottles of liquor shown for supply manifold 20 in FIG. 2 may be employed. It is merely necessary to have at least some of the various bottle receivers disposed at different vertical levels. In some other applications, it may be desirable to draw liquid simultaneously from more than one container on the same manifold. In that event, the receivers for those containers would simply be made to position the container outlets at the same vertical level. In fact, a common variation of the arrangement shown in FIG. 2 is a manifold which is somewhat shorter in length from manifold 40 and which accommodates just two bottle receivers. This type of installation is deemed desirable for bar or lounge operations which do not require a substantial volume of any one type of liquor. Still another use for the two bottle arrangement is in self contained portable bars which would normally be employed for private parties or the like and, therefore, would not require the high volume of available liquor.

Regardless of the specific application of the dispensing manifold, the FIG. 1 arrangement is deemed only typical of one use. Any number of separate types of liquor could be supplied to liquor dispensing devices similar to the devices E shown in FIG. 1 as may be desired by the bar or lounge owner. The actual dispensing equipment is now quite sophisticated and has, in fact, been developed to the point where the systems may be tied into automatic drink counters, cash registers and other ancillary accounting equipment in order that very precise liquor control may be maintained. Obviously, with the arrangement shown in FIG. 1 or a similar arrangement, the liquor supply may be maintained in a separate room so that tight security may be maintained over the liquor itself.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. A liquid dispensing apparatus adapted to regulate liquid flow from a plurality of liquid containers which each have a liquid outlet therein, said apparatus comprising: a closed manifold having a liquid chamber for receiving liquid from said plurality of containers, a manifold liquid outlet communicating with said chamber and a plurality of container receiver means individually disposed along the manifold in fluid communication with said chamber, said receivers being dimensioned to receive and support said containers in a manner whereby all the liquid therein may be selectively emptied therefrom by gravity, said receiver means including means for locating said containers in said receiver means such as to provide a barometric pressure liquid outlet port for each of said plurality of containers, each of said outlet ports being open to atmosphere intermediate said manifold and the respective container and being disposed at a different vertical level than the liquid outlet ports of the remainder of said plurality, all the liquid outlet ports of said plurality being at least submerged in said liquid when said plurality of containers are in position on said receiver means so as to prevent liquid flow therefrom, the highest vertically disposed liquid outlet port for said containers having liquid therein being temporarily removed from submersion as a selected portion of liquid is removed from said manifold through said manifold outlet, whereby air may flow into said highest liquid outlet port for allowing liquid to flow therefrom until the original liquid level is reestablished to prevent further liquid flow.

2. The apparatus as defined in claim 1 further including a rigid container support sleeve associated with each of said plurality of receiver means, said sleeves being selectively movable relative to said receiver means between first non-supporting positions and second supporting positions closely spaced to said containers, and selectively releasable positive retaining means for retaining said sleeves in said supporting positions on said receiver means.

3. The apparatus defined in claim 2 wherein said sleeves each further include a deformable gasket member disposed adjacent the uppermost end thereof, each said gasket being adapted to be deformed by and closely embrace an associated one of said containers.

4. The apparatus as defined in claim 1 wherein said manifold is disposed in a generally horizontal position and said receiver means are disposed generally normal thereto and extend substantially vertically upward therefrom, the container liquid outlet ports for each succeeding container of said plurality of containers from adjacent said manifold liquid outlet being disposed at a higher vertical level than the preceding container.

5. The apparatus of claim 1 wherein each said receiver means comprises an upwardly opening cup-like receptor mounted directly on said manifold.

6. The apparatus of claim 1 wherein said containers have container liquid outlets, a valve body sealingly secured to each said container liquid outlet, each said valve body having a valve body outlet defining said liquid outlet ports, each said valve body outlet being spaced a substantial distance from each said container liquid outlet so that said container liquid outlets are always above the highest liquid level in said receiver means.

7. The apparatus of claim 6 wherein said receiver means includes shelf means for supporting said valve bodies so that substantially the full weight of said containers and the liquid therein is transferred to said receiver means through said valve bodies.

8. The apparatus of claim 7 wherein said valve body includes a support cap portion having a diameter substantially larger than the diameter of said container liquid outlets, and said support cap portions being supported on said shelf means.

9. The apparatus of claim 8 wherein said support cap portion is located between said valve body outlets and said container liquid outlets.

10. A liquid container receiving and supporting structure adapted for use in a container liquid dispensing manifold, comprising in combination:

receptor means having a bottom wall, an open top end and a continuous side wall defining a cup-like structure adapted to receive at least the liquid outlet portion of a liquid container, said bottom wall having a flow port therein adapted for liquid communication with said manifold, a plurality of longitudinal ribs extending along at least a portion of the inside of said side wall from adjacent said bottom wall toward said open end, said ribs further including inwardly extending steps for cumulatively defining a shelf-like area for supporting said container in a precise position in said receptor means whereby the container liquid outlet may be disposed such that substantially all the liquid contents may be selectively drawn therefrom by gravity, that portion of said ribs extending from said steps toward said open end defining guides for a flow control valve; and, a liquid flow control valve defining a liquid outlet port and having a plug portion adapted to be closely received within a container liquid outlet and a selectively movable seal portion for controlling liquid flow from said container, said seal portion having a first normally closed position blocking fluid flow and including an operating stem for engaging a portion of said receptor means when said container and valve are positioned therein whereby said seal portion is moved from said first position to a second opened position to allow liquid to flow from said container through said outlet port, said valve further including means for engaging said shelf-like area for precisely locating and supporting said container in said receptor means.

11. The combination as defined in claim 10 wherein said means on said valve for engaging said shelf-like area comprises an outwardly extending rim on said valve.

12. The combination as defined in claim 10 wherein said receptor further includes a rigid container support sleeve closely associated therewith and adapted for longitudinal movement relative thereto, said sleeve having an open ended generally cylindrical configuration and further having means for selectively retaining it in a desired position relative to said receptor whereby further support for said container may be obtained when said container and flow valve are received in said receptor by moving said sleeve closely adjacent to said container.

13. The combination as defined in claim 12 wherein said sleeve is closely slidably received over the outside of said receptor side wall and further includes a deformable gasket-like member over the outermost end thereof adapted to closely embrace the side wall of said container.

14. The combination as defined in claim 10 wherein said manifold comprises an elongated manifold having an elongated liquid chamber and a plurality of said container receiving and supporting structures are mounted directly on said manifold in longitudinally spaced-apart relationship and said shelf-like areas on said plurality of container receiving and supporting structures being located at progressively greater distances from said manifold from one end of said manifold toward the other end thereof.

15. The combination as defined in claim 11 wherein said means on said valve for engaging said shelf-like area comprises an outwardly extending generally circular rim on said valve, said rim having a diameter substantially greater than said container liquid outlet, and said liquid outlet port in said valve being spaced a substantial distance from said rim.

16. The combination as defined in claim 10 wherein said receptor means is molded in one-piece of synthetic plastic material and includes an externally threaded protrusion extending outwardly from said bottom wall, said flow port extending through said protrusion, said manifold having an internally threaded fitting receiving said protrusion.

17. The combination as defined in claim 16 wherein said manifold is elongated and has a plurality of said fittings longitudinally spaced-apart thereon, each said fitting having one of said receptor means mounted thereto, said shelf-like area on each said receptor means being spaced a different distance from said bottom wall than the other said receptor means.

18. Liquid dispensing apparatus comprising; an elongated manifold having a manifold liquid outlet at one end thereof, a plurality of receptors mounted directly on said manifold in spaced-apart relationship for receiving and supporting inverted containers having barometric pressure container liquid outlets, said receptors having bottom walls including flow ports therethrough communicating with said manifold, said receptors having shelf means spaced above said bottom walls thereof for locating and supporting containers, and said shelf means on said receptors being located at progressively greater distances from said bottom walls when proceeding from said one end of said manifold toward the other end thereof.

19. The apparatus of claim 18 wherein said receptors are cup-like members molded in one-piece of synthetic plastic material and have protrusion means extending outwardly from the bottom walls thereof for cooperating with fittings on said manifold to amount said receptors on said manifold.

20. The apparatus of claim 18 and including a plurality of liquid containers having container liquid outlets receiving valve bodies having valve outlets, said containers being inverted with said valve bodies supported on said shelf means, and said receptors being open to atmospheric pressure.

21. The apparatus of claim 20 wherein said valve bodies have plug portions sealingly received in said container liquid outlets, said valve bodies including generally circular rim portions having a diameter substantially greater than the diameter of said container liquid outlets, said rim portions being supported on said shelf means, and said valve outlets being spaced a substantial distance downwardly from said rim portions.

22. A receptor for supporting and locating containers in a liquid dispensing apparatus comprising; a cup-like member molded in one-piece of synthetic plastic material and having a bottom wall, a peripheral wall and an open upper end, protrusion means extending outwardly from said bottom wall for mounting said member to a dispensing manifold, a flow port through said protrusion means, circumferentially spaced-apart ribs extending longitudinally along the inner surface of said peripheral wall from said bottom wall, and said ribs having upwardly facing support edges spaced a substantial distance below said upper end.

23. The receptor of claim 22 wherein said protrusion means is externally threaded.

24. The receptor of claim 22 wherein said support edges are defined by notches formed in the upper ends of said ribs.

25. The receptor of claim 22 and further including a rigid sleeve member slidably received on said peripheral wall, and selectively releasable restraining means for releasably restraining said sleeve member against movement relative to said peripheral wall.

* * * * *